US008660776B2

(12) United States Patent
Mueller et al.

(10) Patent No.: US 8,660,776 B2
(45) Date of Patent: Feb. 25, 2014

(54) METHOD FOR STARTING AN INTERNAL COMBUSTION ENGINE

(75) Inventors: Norbert Mueller, Farmington Hills, MI (US); Ruediger Weiss, Moetzingen (DE); Tobias Leutwein, Gaisbach (DE); Matthias Walz, Wiernsheim (DE); Elmar Pietsch, Kornwestheim (DE); Harry Friedmann, Vaihingen An Der Enz (DE)

(73) Assignee: Robert Bosch GmbH, Stuttgart (DE)

( * ) Notice: Subject to any disclaimer, the term of this patent is extended or adjusted under 35 U.S.C. 154(b) by 827 days.

(21) Appl. No.: 12/521,513

(22) PCT Filed: Dec. 17, 2007

(86) PCT No.: PCT/EP2007/064076
§ 371 (c)(1),
(2), (4) Date: Sep. 21, 2010

(87) PCT Pub. No.: WO2008/080817
PCT Pub. Date: Jul. 10, 2008

(65) Prior Publication Data

US 2011/0184633 A1 Jul. 28, 2011

(30) Foreign Application Priority Data

Dec. 27, 2006 (DE) ..... 10 2006 061 574
Jun. 15, 2007 (DE) ..... 10 2007 027 709

(51) Int. Cl.
*F02D 29/00* (2006.01)

(52) U.S. Cl.
USPC ..... 701/113; 123/179.12

(58) Field of Classification Search
USPC ..... 701/102, 112–114; 123/179.12–179.16, 123/179.3, 179.5, 179.6, 458
See application file for complete search history.

(56) References Cited

U.S. PATENT DOCUMENTS

| | | | | |
|---|---|---|---|---|
| 4,164,922 | A * | 8/1979 | Eheim et al. | 123/457 |
| 4,515,131 | A | 5/1985 | Suzuki et al. | |
| 5,311,771 | A * | 5/1994 | Young | 73/114.26 |
| 5,604,304 | A * | 2/1997 | Kokubo et al. | 73/114.63 |
| 5,862,795 | A * | 1/1999 | Osanai | 123/520 |
| 6,415,655 | B2 * | 7/2002 | Loof et al. | 73/114.25 |
| 6,575,136 | B1 | 6/2003 | Namari | |
| 6,810,320 | B2 * | 10/2004 | Yamamoto et al. | 701/111 |
| 6,962,224 | B2 * | 11/2005 | Nakanowatari | 180/65.225 |
| 7,191,746 | B2 * | 3/2007 | Nakamura | 123/179.3 |

(Continued)

FOREIGN PATENT DOCUMENTS

| | | |
|---|---|---|
| EP | 0 942 163 | 9/1999 |
| EP | 1 439 300 | 7/2004 |

(Continued)

OTHER PUBLICATIONS

International Search Report for PCT/EP2007/064076, dated Apr. 4, 2008.

*Primary Examiner* — John Kwon
*Assistant Examiner* — Johnny Hoang
(74) *Attorney, Agent, or Firm* — Kenyon & Kenyon LLP

(57) ABSTRACT

A method for starting an internal combustion engine, in which a control unit starts at least one function at a specific crankshaft angle, the function being shifted from the start of the internal combustion engine until a final condition is reached by a relative angle to a later crankshaft angle.

18 Claims, 1 Drawing Sheet

(56) References Cited

U.S. PATENT DOCUMENTS

| | | | | |
|---|---|---|---|---|
| 7,415,955 | B2 * | 8/2008 | Matsuki et al. | 123/179.5 |
| 7,433,778 | B2 * | 10/2008 | Mehnert | 701/103 |
| 2003/0094160 | A1 | 5/2003 | Tani et al. | |
| 2004/0139938 | A1 * | 7/2004 | Tanei et al. | 123/179.3 |
| 2005/0183700 | A1 * | 8/2005 | Dolker | 123/486 |
| 2006/0081207 | A1 * | 4/2006 | Nakamura | 123/179.3 |
| 2006/0157023 | A1 * | 7/2006 | Matsuki et al. | 123/339.16 |
| 2007/0062477 | A1 * | 3/2007 | Shimazaki et al. | 123/179.16 |
| 2008/0011253 | A1 * | 1/2008 | Nakamura | 123/90.15 |
| 2008/0135014 | A1 * | 6/2008 | Blessing et al. | 123/299 |
| 2008/0314364 | A1 * | 12/2008 | Okamoto | 123/458 |
| 2010/0132670 | A1 * | 6/2010 | Okamoto | 123/458 |

FOREIGN PATENT DOCUMENTS

| | | |
|---|---|---|
| FR | 2 853 935 | 10/2004 |
| JP | 11-294236 | 10/1999 |
| JP | 2001-153016 | 6/2001 |
| JP | 2001-200776 | 7/2001 |
| JP | 2004-316561 | 11/2004 |
| JP | 2006-170083 | 6/2006 |
| WO | 2004/070184 | 8/2004 |

* cited by examiner

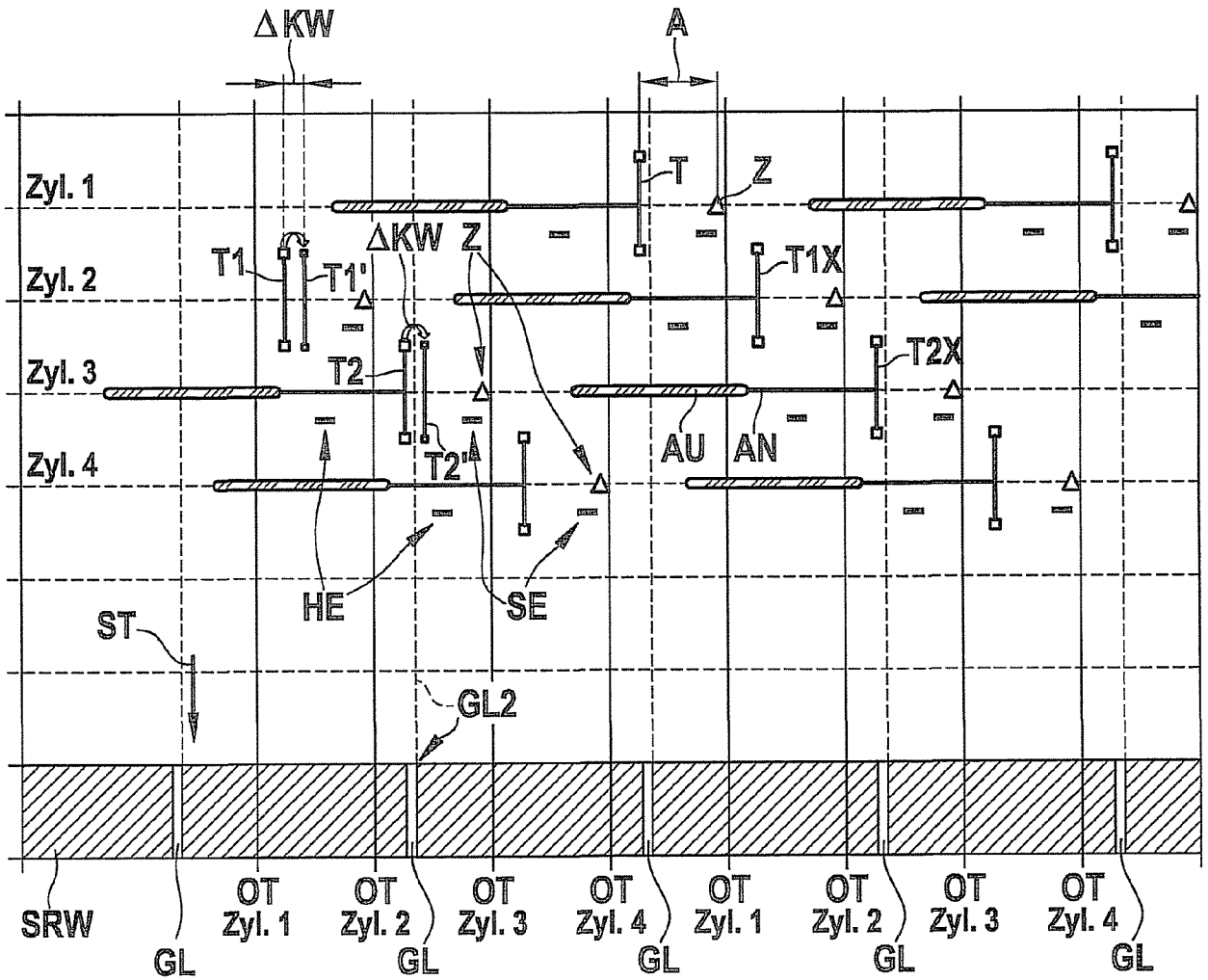
Zyl. 1
Zyl. 2
Zyl. 3
Zyl. 4
ΔKW
A
T
Z
T1
T1'
ΔKW
Z
T1X
T2
T2'
T2X
AU
AN
HE
SE
ST
GL2
OT Zyl. 1
OT Zyl. 2
OT Zyl. 3
OT Zyl. 4
GL
SRW

METHOD FOR STARTING AN INTERNAL COMBUSTION ENGINE

FIELD OF THE INVENTION

The present invention relates to a method for starting an internal combustion engine, in which a control device starts at least one function at a specific crankshaft angle.

BACKGROUND INFORMATION

Various methods are currently used for synchronization, that is, for finding the position of the angle of the crankshaft of the internal combustion engine when starting. In a first method, the rundown position of the crankshaft is determined as the internal combustion engine is shut off, and this information is stored in the engine control unit until a restart. This method is also referred to as rundown detection and involves greater uncertainties since, for instance, the internal combustion engine could be turned over when the ignition is switched off and thus when the control unit is turned off, for example, by pushing the vehicle when the gear is engaged. This first method is also called synchronization stage 1.

In a second method, a signal of a camshaft sensor is evaluated, the associated camshaft sensor wheel being suitably designed to allow for the position to be found as quickly as possible. Such a sensor wheel is also known as a quick-start sensor wheel. In internal combustion engines that have an adjustable camshaft, this type of synchronization involves uncertainties because it is possible that at the time of the start the camshaft is erroneously not engaged. This method is also called synchronization stage 2. In a third method, the crankshaft sensor and the camshaft sensor are evaluated at the time of the gap in the crankshaft sensor wheel. This type of synchronization involves the least uncertainty since the crankshaft position and camshaft position associated with the gap in the sensor wheel can be determined reliably. Such a method is also known as synchronization stage 3.

The aforementioned methods of synchronization can run in parallel to each other. The higher the synchronization stage, the lower is the uncertainty in ascertaining the crankshaft angle. The synchronization stage respectively reached while the crankshaft of the internal combustion engine begins to rotate when starting the internal combustion engine may be indicated, for example, by a variable stored in a control unit.

As soon as the synchronization has occurred, angularly synchronous computation grids (also known as tasks) may be executed, which are able to trigger a fuel injection or a firing of a cylinder, for example. The position of the angularly synchronous computation grids relative to the top dead center of a reference cylinder is normally adjustable. At different crankshaft angles, different computation grids having different functions may be executed.

Thus, as soon as the crankshaft begins turning when starting an internal combustion engine, angularly synchronous computation grids may be started according to the information of a rundown detection or of the camshaft sensor in synchronization stage 1 or 2. Engine control functions such as an injection or ignition, for example, which are processed in these angularly synchronous computation grids, may indeed be called up when starting the internal combustion engine, but it may happen that an actual triggering of the corresponding output stage, for example of the ignition or the triggering of an injector or the like, must be suppressed until synchronization stage 3 is reached, that is, until the crankshaft angle may be determined with the greatest possible accuracy.

Reaching synchronization stage 3 thus means that the crankshaft sensor wheel gap or, in the case of a sensor wheel having an asynchronous graduation, the asynchronous arrangement of teeth and tooth gaps replacing the sensor wheel gap, must have been detected. The sensor wheel gap is defined by the installation of the sensor wheel and depends on the particular model of the internal combustion engine and may be located, for example, at 50° crankshaft angle before the top dead center (TDC) of a reference cylinder.

Various boundary conditions may require that a particular angularly synchronous computation grid be situated at a defined angle before the top dead center. In addition it may be the case that the accuracy of an engine control function computed in this computing grid requires that, when starting the internal combustion engine, computations or computation outputs may occur only at synchronization stage 3, that is, that a particular functionality must always wait for a detected gap in the sensor wheel before being executed when starting the internal combustion engine.

In this context it may happen that the start of the internal combustion engine coincides with a crankshaft angle at which the angularly synchronous computation grid for a function was just exceeded. Thus, for example, if the start of the internal combustion engine begins at a crankshaft angle of 50° before the top dead center of a cylinder, and if an angularly synchronous computation grid for a specific functions begins, for example, 60° before the top dead center of the cylinder, then this function is executed only after the crankshaft angle of 50° before the top dead center of the cylinder has been reached again. This means that the associated function is executed only at a considerably later time, that is, after one crankshaft rotation.

SUMMARY OF THE INVENTION

One objective of the exemplary embodiments and/or exemplary methods of the present invention is to indicate a method and a device as well as a computer program that effect an earliest possible execution of angularly synchronous computation grids when starting an internal combustion engine.

This objective is achieved by a method for starting an internal combustion engine, in which a control device starts at least one function at a crankshaft angle, the function being shifted from the start of the internal combustion engine until reaching a final condition by a relative angle to a later crankshaft angle. The function is started in an angularly synchronous computation grid, which means that the function is started at a defined crankshaft angle. In the present context, a function is understood as any type of computation, or control or regulation of functions of the internal combustion engine such as, for example, the determination of an ignition point, the determination of an injection point, the determination of an injection quantity and the like. Starting the internal combustion engine is here understood as switching on a control unit while the crankshaft is not rotating. The start of the internal combustion engine may also be defined as the instant at which the starter is actuated or the crankshaft begins rotating. A later crankshaft angle is understood here as a crankshaft angle that is reached later in time. The relative angle is thus defined positively in the direction of rotation. There may be a provision for the function to control an event that is executed one execution angle after the start of the function, and for the relative angle to be smaller than the execution angle.

The function started at the particular crankshaft angle computes or controls an event that occurs by the execution angle after the particular crankshaft angle. The function thus requires a certain time and thus a certain elapsed crankshaft angle until the result of the function is available. The relative angle is now positioned in such a way that the crankshaft angle, at which the result of the function is available, does not have to be shifted. The relative angle may be chosen to be of such a size that a computation grid situated in time ahead of the sensor wheel gap following the shift comes to be situated after the sensor wheel gap. With the gap, synchronization stage 3 is reached, and the injection may be immediately enabled in the shifted computation grid.

Because of the shift of the crankshaft angle at which it is started, the function must deliver the result more quickly, which is ensured, however, by the low rotational speed of the crankshaft while starting the internal combustion engine. There may be a further provision for the final condition to be the detection of a sensor wheel mark for a designated absolute crankshaft angle, in particular the detection of a sensor wheel gap. The final condition, however, may also be that the crankshaft has reached a minimum rotational speed. When the final condition is reached, the shift by the relative angle is cancelled. There may be a provision for the function to include the computation of injection parameters and/or an ignition point of at least one cylinder of the internal combustion engine. The injection parameters may include at least one start of an injection.

The objective mentioned at the outset is also achieved by a device, particularly a control unit or an internal combustion engine, which is set up for carrying out the method according to the exemplary embodiments and/or exemplary methods of the present invention, and by a computer program having program code for carrying out all steps of a method according to the present invention when the program is executed on a computer.

An exemplary embodiment of the present invention is explained in more detail below with reference to the accompanying drawing.

BRIEF DESCRIPTION OF THE DRAWING

FIG. 1 shows the time sequence of functions for a 4-cylinder internal combustion engine.

DETAILED DESCRIPTION

FIG. 1 shows a diagram that illustrates the execution of various engine functions over the crankshaft angle. The crankshaft angle (OKW) is indicated on the basis of the top dead centers OT of cylinders 1 through 4 of a 4-cylinder internal combustion engine. The top dead center of cylinder 1 is indicated as OT Zyl. 1, the top dead center of cylinder 2 is indicated as OT Zyl. 2, the top dead center of cylinder 3 is indicated as OT Zyl. 3, and the top dead center of cylinder 4 is indicated as OT Zyl. 4. The signal of a crankshaft sensor SKW is represented as a line, the sensor wheel gap being respectively indicated by GL. The internal combustion engine is started at a crankshaft angle indicated by an arrow ST, which is situated a few degrees after the sensor wheel gap.

Thus, until sensor wheel gap GL is reached again, which crankshaft angle is indicated by a vertical dashed line GL2, there is no synchronization of the crankshaft sensor signal on the basis of the sensor wheel gap. After the sensor wheel gap has been reached at crankshaft angle GL2, a synchronization is provided. Calls of functions (also known as tasks) are indicated in FIG. 1 as vertical lines having squares at their ends. One of these functions is marked by reference symbol T. Functions are called to ascertain control and regulation variables of an internal combustion engine or to perform certain actions of the internal combustion engine such as, for example, precipitating an injection or firing a spark plug, the functions being performed by control unit or a computer program executed on the control unit. Functions T control events that are executed an execution angle A after the functions are started.

For example, functions T control an ignition Z, which is started an execution angle A after the start of the functions T. Intake phases for the respective cylinder are indicated as a solid horizontal line, one of the intake phases again being indicated by a reference symbol AN to facilitate identification. The exhaust phase AU preceding intake phase AN is represented here respectively as a checkered rectangle. Stratified injections SE are represented as adjacent rhombuses connected by a line, while homogenous injections HE are represented as adjacent rectangles connected by a line. Ignitions Z are respectively shown as triangles. The functions or operations associated with cylinders 1 through 4, these cylinders being indicated as Zyl. 1 through Zyl. 4, are shown in the representation of FIG. 1 one on top of the other and are provided with the corresponding cylinder name with a dashed line.

At the bottom, FIG. 1 shows the signal pattern of the crankshaft sensor, it being assumed that the internal combustion engine has a start position directly after the sensor wheel gap. What is shown are the 180° periodic functions for the individual cylinders, which in this case are shifted to the right (retarded) until the first gap in the sensor wheel is detected. This makes it possible to execute as quickly as possible a functionality that requires synchronization stage 3, that is, the existence of a synchronization on the basis of the sensor wheel gap. In the event that this functionality represents the ignition output, for example, an ignition of cylinder 3 may be initiated by this measure in the exemplary embodiment of FIG. 1, while without the shift by a relative angle ΔKW in accordance with the exemplary embodiments and/or exemplary methods of the present invention only an ignition of cylinder 4 would be possible.

A function T1 of cylinder 2 and a function T2 of cylinder 3 are situated between the start of internal combustion engine ST and the crankshaft angle at which sensor wheel gap GL was first detected. The two functions T1 and T2 thus occur between the start of the internal combustion engine at crankshaft angle ST and the availability of a reliable synchronization at crankshaft angle GL2. The exemplary embodiments and/or exemplary methods of the present invention now provides for shifting these functions by a relative angle ΔKW toward later crankshaft angles. Relative angles ΔKW are respectively represented by curved arrows, function T1 is shifted by relative angle ΔKW to function T1' and function T2 is shifted by relative angle ΔKW to function T2'. In the exemplary embodiment shown in FIG. 1 this has the consequence that function T2' is now called after the detection of sensor wheel gap GL at crankshaft angle GL2, a crankshaft angle synchronization thus now being available for function T2', while this would not have been the case in the non-shifted function T2.

Without the shift according to the exemplary embodiments and/or exemplary methods of the present invention by relative angle ΔKW, function T2 would have been called for the first time two crankshaft rotations later at T2*x*. The position of T1/T1' involves uncertainties. Therefore, only functions that do not require great accuracy may be computed in T1'. Thus, for example, the homogenous injection quantity for cylinder 3 could be computed and output in T1'. The accuracy would not be sufficient for a stratified injection, nor for an ignition.

Of course, the ignition may be computed with the required accuracy for cylinder 3 in T2'.

Only computations that do not require the highest accuracy should be executed in T1'. Thus, in the present example, there is a computational grid at 60° crankshaft angle ahead of the top dead center and it computes a function, for example an ignition angle of the next combustion. The output of this function requires, however, that the engine control system is synchronized with the highest reliability and must thus wait for the gap in the crankshaft sensor wheel, which in the present case is at a crankshaft angle of 50° ahead of the top dead center, for example. Thus, in the event of a starting operation, one must wait for the gap, but when it is detected and thus the computation or output of the function is enabled, then the corresponding computation grid has just passed and one must wait for the next corresponding computation grid, which in a 4-cylinder engine is normally situated 720° periodically, that is, which in this example will occur again only after 710° crankshaft angle. This case is illustrated in FIG. 1 in the example of cylinder Zyl. 3.

In accordance with the exemplary embodiments and/or exemplary methods of the present invention, in the event of a starting operation, the computation grid is shifted only briefly to other crankshaft angle positions in order to accelerate the starting behavior of the internal combustion engine. In the event of a starting operation, the angularly synchronous computation grid is thus shifted temporarily to other angular positions. In the indicated example it would make sense to shift the computation grid, which in normal operation of the engine is at 60° crankshaft angle, to 50° crank angle before the top dead center until the gap in the sensor wheel is detected. The advantage is an accelerated starting behavior. In the indicated example, this results in a combustion that occurs earlier by a crankshaft angle of 180°, that is to say, ignition occurs earlier by one top dead center (in the 4-cylinder engine, a top dead center of a cylinder is reached every 180° crankshaft angle), which yields an acceleration of the starting operation by up to approx. 25%, assuming the usual start times of an internal combustion engine and the usual rotational speeds of a starter.

What is claimed is:

1. A method for starting an internal combustion engine, the method comprising:

starting, using a control unit, at least one function at a specific crankshaft angle; and shifting a start of a function of the at least one function, from the starting of the internal combustion engine until reaching a final condition, by a shift angle to a later crankshaft angle.

2. The method of claim 1, wherein the function, when executed by the control unit, controls an event that is executed one execution angle after the start of the at least one function, and the relative shift angle is smaller than the execution angle.

3. The method of claim 1, wherein the final condition is a detection of a sensor wheel mark for a designated absolute crankshaft angle.

4. The method of claim 1, wherein the final condition is that a crankshaft has reached a minimum rotational speed.

5. The method of claim 1, wherein the function includes computing at least one of injection parameters and an ignition point of at least one cylinder of the internal combustion engine.

6. The method of claim 5, wherein the injection parameters include a start of an injection.

7. The method of claim 1, wherein the final condition is a detection of a sensor wheel gap for a designated absolute crankshaft angle.

8. The method of claim 1, wherein the function, when executed by the control unit, controls an event that is executed one execution angle after the start of the at least one function, and the relative shift angle is smaller than the execution angle, and wherein the final condition is a detection of a sensor wheel mark for a designated absolute crankshaft angle.

9. The method of claim 8, wherein the function includes computing at least one of injection parameters and an ignition point of at least one cylinder of the internal combustion engine, and wherein the injection parameters include a start of an injection.

10. The method of claim 1, wherein the function, when executed by the control unit, controls an event that is executed one execution angle after the start of the at least one function, and the relative shift angle is smaller than the execution angle, wherein the final condition is that a crankshaft has reached a minimum rotational speed.

11. The method of claim 10, wherein the function includes computing at least one of injection parameters and an ignition point of at least one cylinder of the internal combustion engine, and wherein the injection parameters include a start of an injection.

12. A starting control unit for starting an internal combustion engine, comprising:

a control unit for starting at least one function at a specific crankshaft angle; and a shifting arrangement to shift a start of a function of the at least one function, from the starting of the internal combustion engine until reaching a final condition, by a shift angle to a later crankshaft angle.

13. A computer readable medium having a computer program that is executable by a computer, comprising;

a program code arrangement including program code for starting an internal combustion engine by performing the following:

starting, using a control unit, at least one function at a specific crankshaft angle; and shifting a start of a function of the at least one function, from the starting of the internal combustion engine until reaching a final condition, by a shift angle to a later crankshaft angle.

14. The computer readable medium of claim 13, wherein the final condition is a detection of a sensor wheel mark for a designated absolute crankshaft angle.

15. The computer readable medium of claim 13, wherein the function, when executed by the control unit, controls an event that is executed one execution angle after the start of the at least one function, and the relative shift angle is smaller than the execution angle.

16. The computer readable medium of claim 13, wherein the final condition is that a crankshaft has reached a minimum rotational speed.

17. The computer readable medium of claim 13, wherein the function includes computing at least one of injection parameters and an ignition point of at least one cylinder of the internal combustion engine.

18. The computer readable medium of claim 17, wherein the injection parameters include a start of an injection.

* * * * *

UNITED STATES PATENT AND TRADEMARK OFFICE

CERTIFICATE OF CORRECTION

PATENT NO. : 8,660,776 B2
APPLICATION NO. : 12/521513
DATED : February 25, 2014
INVENTOR(S) : Mueller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1277 days.

Signed and Sealed this
Twenty-ninth Day of September, 2015

Michelle K. Lee

Michelle K. Lee
*Director of the United States Patent and Trademark Office*